US007137230B2

(12) United States Patent
McCarthy

(10) Patent No.: US 7,137,230 B2
(45) Date of Patent: Nov. 21, 2006

(54) POST SUPPORT SYSTEM

(75) Inventor: Peter McCarthy, Woodbridge (CA)

(73) Assignee: Royal Group Technologies Inc., Woodbridge (CA)

( * ) Notice: Subject to any disclaimer, the term of this patent is extended or adjusted under 35 U.S.C. 154(b) by 255 days.

(21) Appl. No.: 10/445,004

(22) Filed: May 27, 2003

(65) Prior Publication Data

US 2004/0003568 A1 Jan. 8, 2004

(30) Foreign Application Priority Data

Jun. 6, 2002 (CA) ..... 2390351

(51) Int. Cl.
*E04C 3/30* (2006.01)

(52) U.S. Cl. ..... 52/736.1; 52/720.2; 52/736.3; 52/738.1

(58) Field of Classification Search ..... 52/292, 52/165, 169.13, 736.2, 720.2, 169.9, 721.3, 52/724.1, 731.1, 732.2, 736.1, 632, 738.8, 52/738.1, 736.3, 720.1; 248/156, 530, 159, 248/158; 256/24, 59, 65.14, DIG. 5, 73
See application file for complete search history.

(56) References Cited

U.S. PATENT DOCUMENTS 310,807 A * 1/1885 Ferer ..... 52/720.2
1,726,133 A * 8/1929 Wilson ..... 52/187
2,669,434 A * 2/1954 White ..... 256/59
2,918,150 A * 12/1959 Blum ..... 52/720.2
3,018,077 A * 1/1962 Buehler ..... 248/539
3,256,658 A * 6/1966 Seery ..... 52/292
3,352,541 A * 11/1967 Thom ..... 256/21
3,375,620 A * 4/1968 Phillips ..... 52/28
3,995,833 A * 12/1976 McLaughlin et al. ..... 256/59
4,104,000 A * 8/1978 Fleischmann ..... 403/7
4,546,889 A * 10/1985 Schoumaker et al. .... 211/105.3
4,765,596 A * 8/1988 Fontana ..... 256/65.14
4,809,955 A * 3/1989 Veilleux ..... 256/65.02
5,035,401 A * 7/1991 Solter ..... 256/19
5,203,817 A * 4/1993 Klumpjan ..... 52/298
5,263,297 A * 11/1993 Kim ..... 52/723.1
5,402,614 A * 4/1995 Jewell ..... 52/299
5,444,951 A * 8/1995 Scott et al. ..... 52/169.9
5,617,697 A * 4/1997 Erwin ..... 52/737.4
5,876,021 A * 3/1999 Spence et al. ..... 256/19
RE36,550 E * 2/2000 West ..... 52/165
6,029,954 A * 2/2000 Murdaca ..... 256/59
6,125,598 A * 10/2000 Lanphier ..... 52/182
6,141,928 A * 11/2000 Platt ..... 52/296
6,205,722 B1 * 3/2001 Bromley et al. ..... 52/182
6,209,267 B1 * 4/2001 Dantzer ..... 52/79.6
6,213,452 B1 * 4/2001 Pettit et al. ..... 256/59
6,568,145 B1 * 5/2003 Bartel ..... 52/741.2
6,568,658 B1 * 5/2003 Strome ..... 256/65.14
6,591,570 B1 * 7/2003 Miller, Jr. ..... 52/632
6,634,154 B1 * 10/2003 Palencar ..... 52/720.2

* cited by examiner

*Primary Examiner*—Peter M. Cuomo
*Assistant Examiner*—Erika Garrett

(57) ABSTRACT

An internal support system for a hollow plastic post comprising a rigid column on to which the post can be sleeved, a member secured to the lower end of the column for securing same upright, and at least one support bracket attachable to the column at a selected point and configured to be received into the lower end of the post to provide internal support for a post sleeved on the column and over the bracket.

8 Claims, 8 Drawing Sheets

22
20
9
17
21
18
18
21
S2
6
16
14
15
12
13
13

9
17
20
21
18
18
6
11
7

POST SUPPORT SYSTEM

FIELD OF THE INVENTION

This invention relates to plastic posts such as are used in railings or fencing or for supporting decks, platforms or the like and particularly to ornamental plastic posts.

BACKGROUND OF THE INVENTION

Plastic posts are conveniently formed or molded as longitudinal hollow plastic members which are supported in some manner in an upright postion. To provide the ornamental or decorative effect they may combine sections along their lengths or height that vary in cross sectional configuration.

For example, a hollow plastic post in wide spread usage and known as a Colonial Post has upper and lower sections which are of square cross section while sections in between have a somewhat vase-like or barrel shape with the junctures between the sections presenting raised ring ribs.

To provide support for such ornamental hollow posts conventionally they are filled with concrete and anchored in some manner to the underlying support surface.

With such conventionally concrete filled posts, the filling of the posts with concrete is awkward and there is the undesirable weight of a column of concrete. After the post being filled, the concrete cannot be removed without destroying the post so that it is not practical to move the post to a different location. Moreover, railings, studs and the like are not readily attachable to such concrete filled posts.

It is the object of this invention to provide a support system for such hollow plastic posts which enables them to be easily and quickly erected or dismantled and which enables railings, studs or other members to be readily secured thereto by conventional fasteners.

SUMMARY OF THE INVENTION

According to the present invention, there is provided a very simple internal support system for internally supporting a hollow plastic post, the system comprising a rigid column on to which the hollow post can be sleeved, a base support for the column to secure same to a support surface with the column upright, and at least one support bracket receivable into at least the lower end of the hollow post, the bracket being securable to the column at a desired selected point and being configured to provide internal post support.

According to the preferred form of the invention, the rigid column comprises a metal tube such as a metal pipe.

Again according to the preferred form of the invention, the base support for the metal tube comprises a metal member welded or otherwise secured to the tube at the lower end thereof.

Again according to the preferred form of the invention, the bracket comprises a metal bracket sleevable on the tube.

Still again, according to the preferred form of the invention, the metal bracket has a web provided with an opening therethrough to receive the tube. The bracket web has means projecting out of the plane thereof for securing the bracket to the tube at any selected position. Further, the bracket has flange means at the ends thereof preferably projecting from the side of said web opposite to the securing means to provide snug fitting backing for wall areas of the hollow plastic post when same is sleeved on to the tube to and over the bracket to enable rails or other members to be positively secured to the post.

As the invention is particularly applicable to decorative hollow plastic posts having sections of different cross sectional configurations, the said bracket is configured to be received into at least one end of the hollow plastic post to be supported.

One of the very widely used decorative plastic posts is known as the Colonial Post which has a square cross section bottom section, intermediate sections of somewhat vase-like or barrel shape having circular cross sections with the sections ending in a rounded raised ring ribs.

For the Colonial Post, the invention provides that the bracket to be affixed to the pipe is configured to snugly fit within the bottom square cross section section while a further bracket arrangement is provided to snugly fit within the top square cross section sections so that both the bottom and top square section sections have internal support to provide fastener holding power for attachment of rails or other members thereto.

There and other features of the invention will become apparent from the following detailed description taken in conjunction with the accompanying drawings.

DETAILED DESCRIPTION ACCORDING TO THE PREFERRED EMBODIMENTS OF THE PRESENT INVENTION

Figure 1:
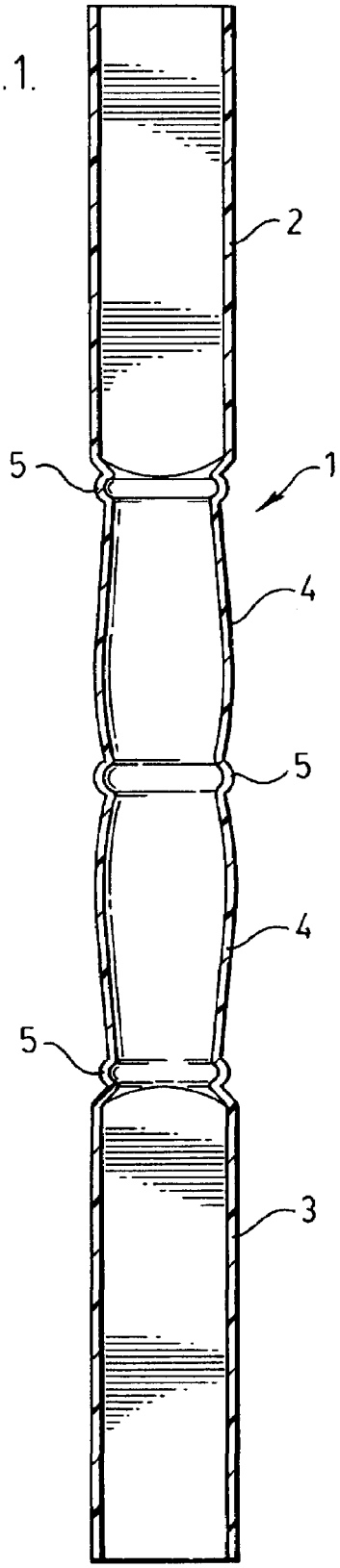
FIG. 1 is an elevational view of a hollow plastic post shown as having the configuration of a Colonial Post.

FIG. 1 illustrates a hollow plastic post 1 whose shape is that of a post known as a Colonial Post which has been particularly selected for illustration since it is a very widely used post. Post 1 has an upper square cross section section 2, a lower square cross section section 3, and intermediate sections 4 which are somewhat vase-like or barrel shaped which end in raised annular rings 5.

Post 1 is formed or molded from any suitable plastic material with the internal contours corresponding to the exterior contours, that is, the interior of the end sections 2 and 3 are a square and interior of the intermediate sections 4 are circular in cross section.

Figure 2:
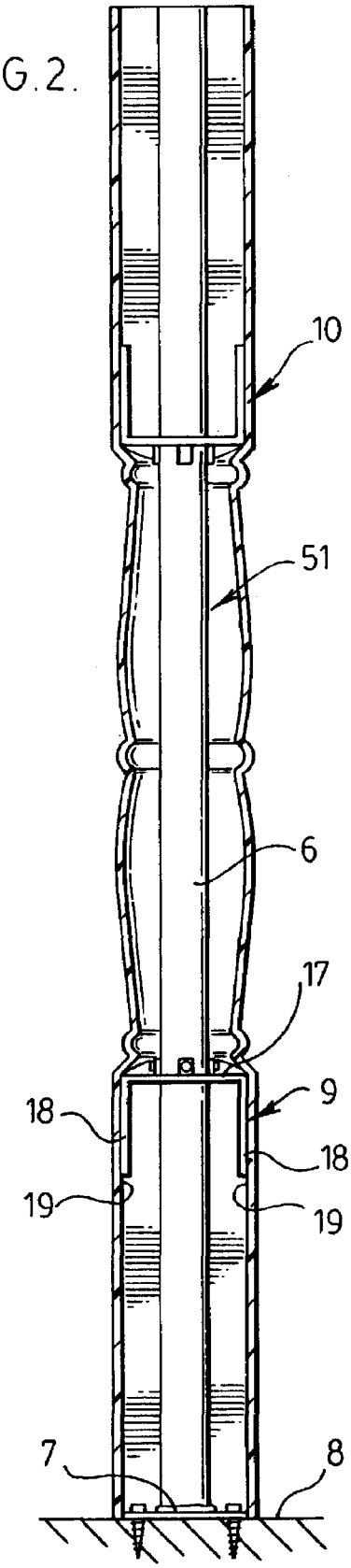
FIG. 2 is a vertical section through the post of FIG. 1 shown it internally supported by an internal support system embodying the invention.

As illustrated in FIG. 2, the internal support system generally designated at S1 comprises a rigid column 6 secured in an upright position through a member in the form in the embodiment of FIG. 2 of base plate 7 secured to the lower end of the column 6, the member 7 being secured to a support surface 8. Secured to the column 6 is a support bracket generally designated at 9 which is configured to be received within the lower end section 3 of post 1 whereby post 1 can be sleeved on the column 6 and over the support bracket 9 with the support bracket providing internal support in the post section 3.

A second support bracket generally designated at 10 receivable within the upper square cross section post portion 2 is sleeved on the column 6 and into the upper end of the post section 2 to provide internal support for this upper post section 2.

According to the preferred form of the invention, the column 6 comprises a metal tube which may, for instance, be a steel or aluminum pipe and for the installations using the base plate 7 for securing the metal tube or column 6 to a support surface with the tube in an upright position the base plate is secured, preferably by welding, to the bottom end of the tube 6.

Figures 4, 5:
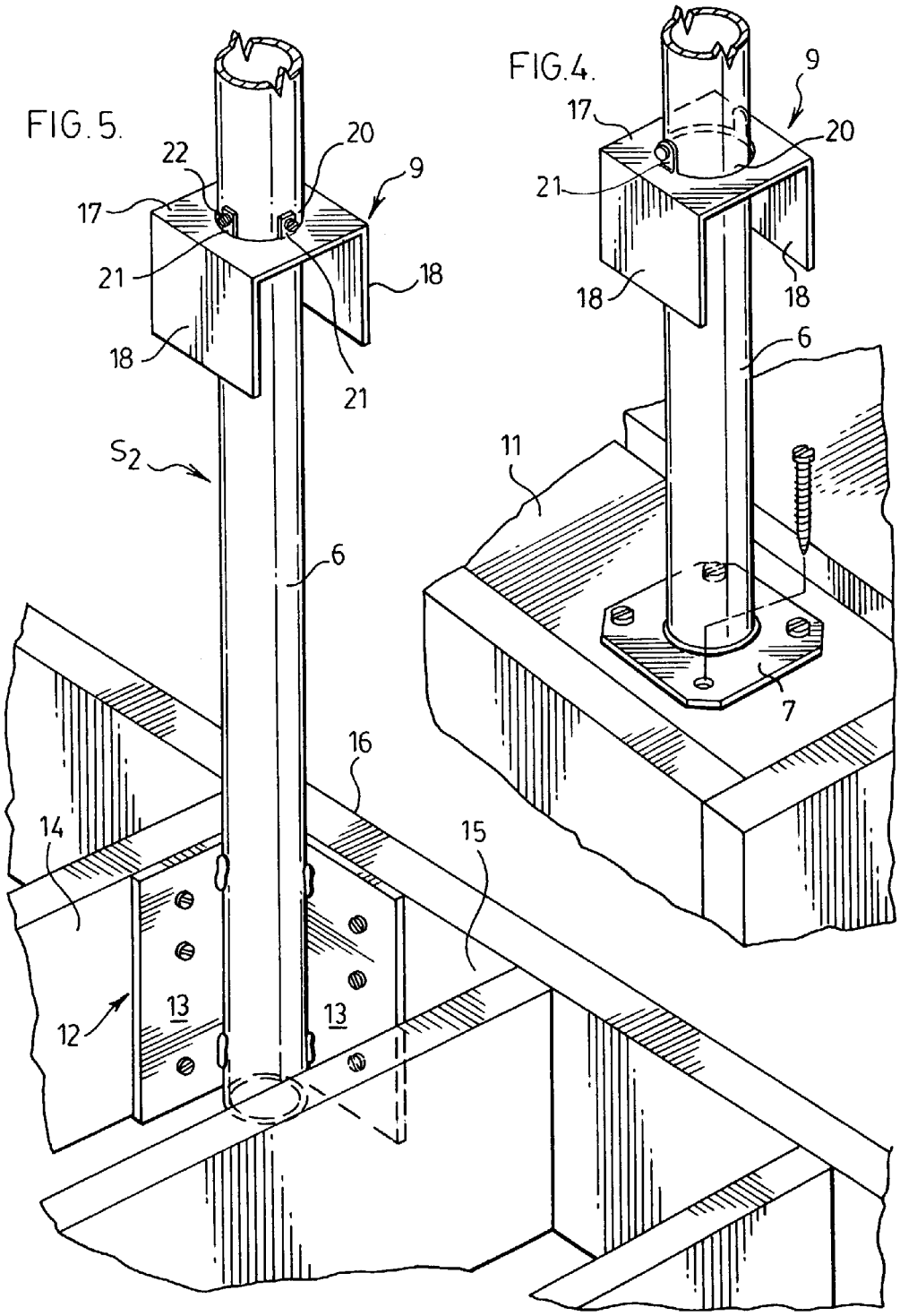
FIG. 4 is an enlarged broken away perspective view illustrating the securement of the rigid central column of the internal support system in an unright position on a stair by means of a base plate.
FIG. 5 is a view similar to FIG. 4 but showing the central support tube secured in the upright position by means of a right angular member secured to the lower end of the tube.

In the illustration in FIG. 4, the tube 6 is shown mounted to a stair 11. FIG. 5 illustrates the lower part of an internal support system S2 which differs from support system S1 only in that it has an alternative mounting arrangement for the tube 6. In this case, a right angular member 12 is welded at the bottom of the tube 6, such that it presents right angularly disposed planar wings 13 whose planes are parallel to the axis of the tube 6. These wings 13 are secured to right angularly disposed surfaces 14 and 15 of a support structure 16.

Figure 3:
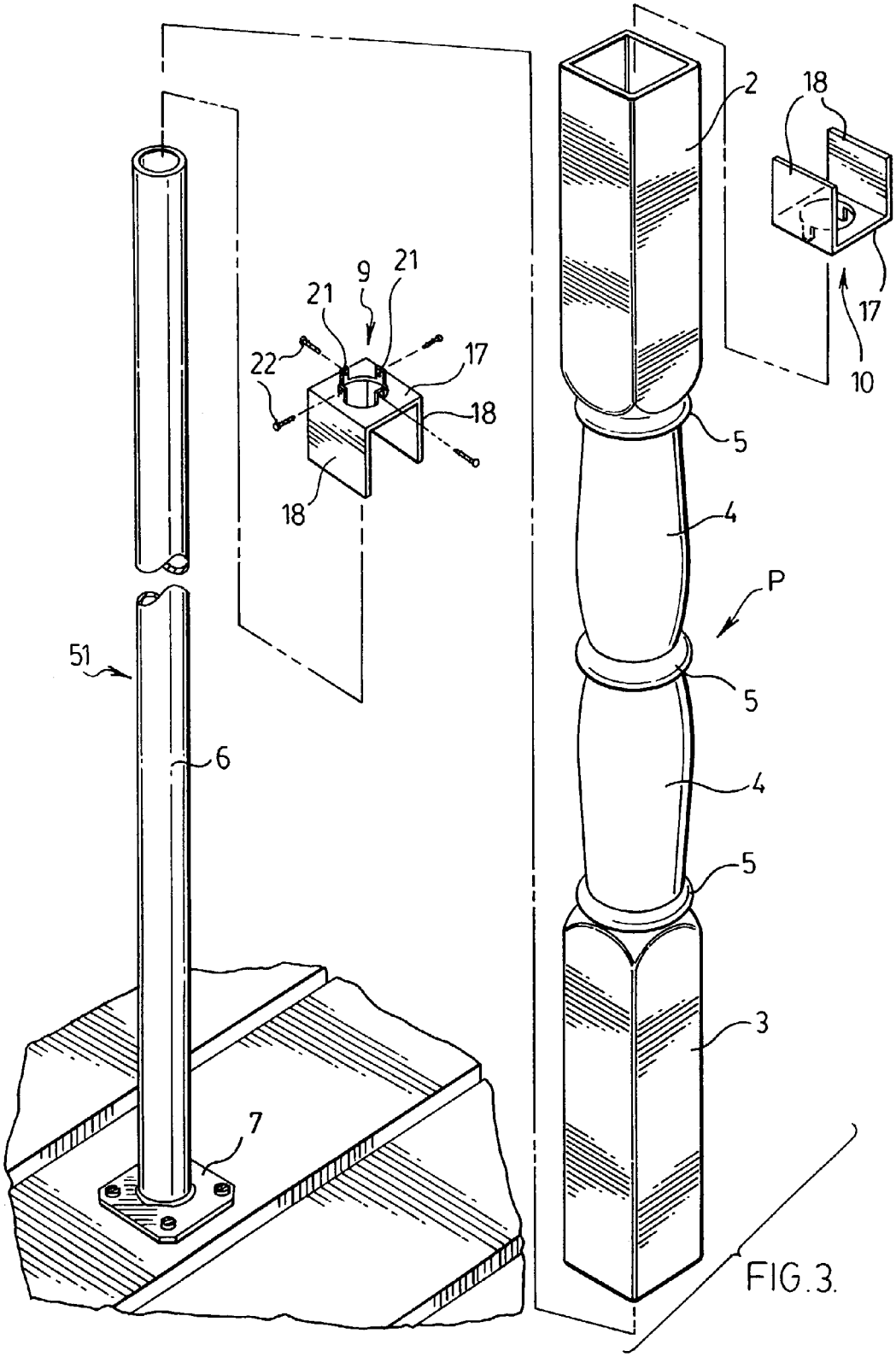
FIG. 3 is an exploded view illustrating the sequence of assembly of the internal support system and the hollow post to provide the internally supported post shown in FIG. 2.

As illustrated in FIGS. 3, 4 and 5, the support bracket 9 is U-shaped being formed of a metal strip having a web 17 of a length to span between opposed inner walls of the square cross section lower end section 3 of the hollow plastic post. This web ends in right angularly turned flanges 18 which are in snug fitting juxtaposition to portions of opposed interior areas of the interior walls 19 of the post section 3. These metal flanges 18 not only provides reinforcement to the post walls but also provide fastener or screw holding power for screws driven through the post and into the flanges to attach rails, studs or the like to the post.

The web 17 is provided with a central hole 20 to enable same to be sleeved on to the tube 6. This web also has ears 21 struck up out of the plane thereof at the edge of the hole 20.

These ears 21 preferably project out of the plane of the web 19 in the opposite direction to the flanges 18 and serve as the means of securing the support bracket 9 to the tube 6 by means of screws 22 passing through the ears and into the tube 6.

The second support bracket 10 which is receivable into and snugly fits against the interior of the upper post section 2, for inventory purposes, is preferably identical in construction to support bracket 9 and its elements bear the same numeral designation as those of support bracket 9. It will be understood, however, that the bracket 10 does not require to have the ears 21 since it does not have to carry any post load and does not have to be secured to the tube as is the case for the bracket 9. Instead, because bracket 10, like bracket 9, is configured to fit snugly into the post section it is to support, bracket 10 is simply forced into the upper end of the post and pressed downwardly to the selected position in post section 2 where it is desired to attach a rail or other member to the post. The friction between the flanges 18 of the snugly fitting bracket 10 and the interior post walls they contact firmly holds the bracket in position.

It will be understood that the webs 17 of the support brackets 9 and 10 will be oriented so that when they are assembled within the hollow post they will be in vertical registration as illustrated in FIG. 2.

Figure 6:
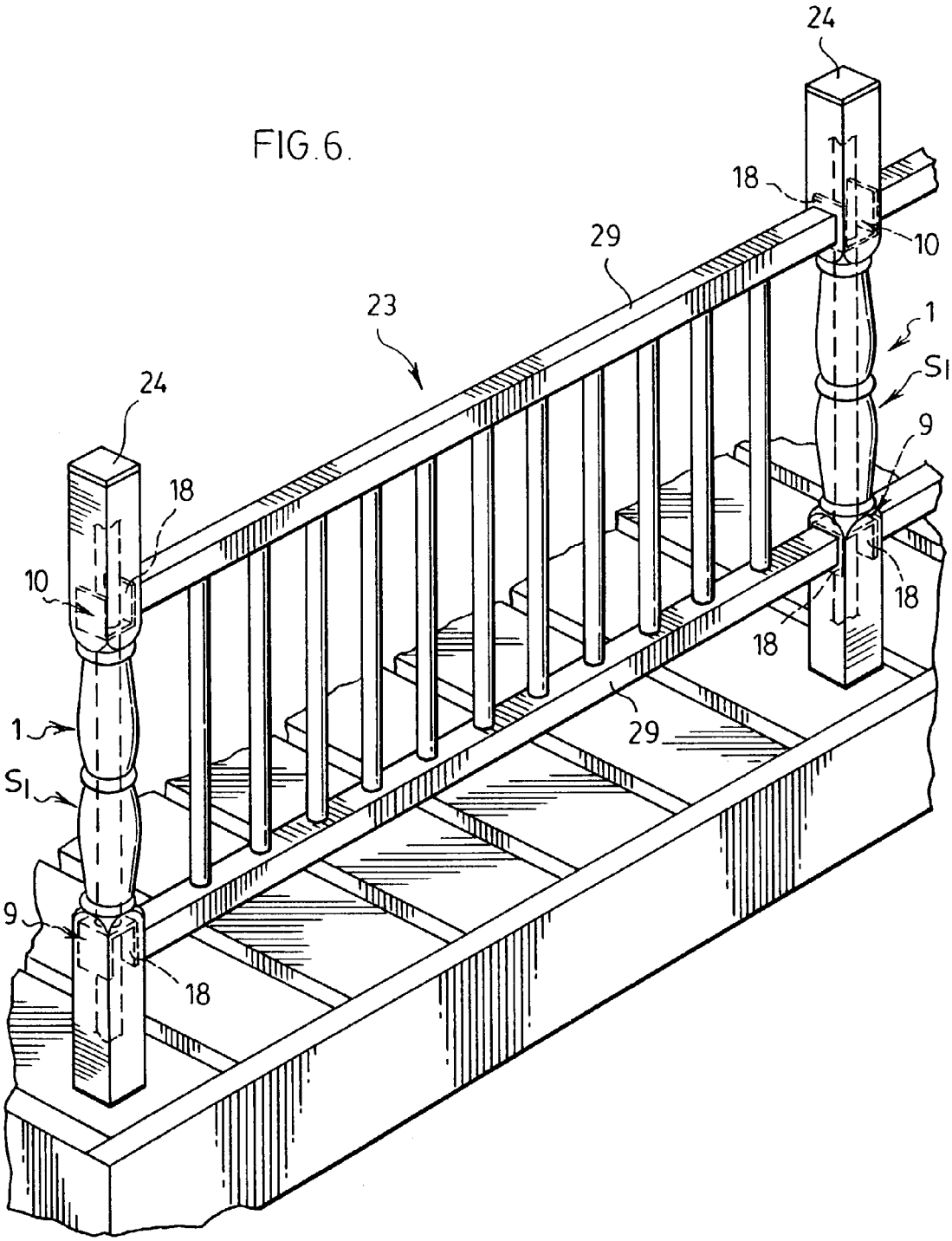
FIG. 6 illustrates the use of the internally supported posts corresponding to the post of FIG. 1 to provide a railing.

FIG. 6 shows a pair of Colonial Posts 1 internally supported in accordance with the invention between which are secured a railing formation 23 going up a gradual set of steps.

While the bottom mounting plate is not visible in FIG. 6, the internal support system would be that of S1 shown in dotted lines. To complete the posts, the open upper ends are closed by caps 24.

Figure 7:
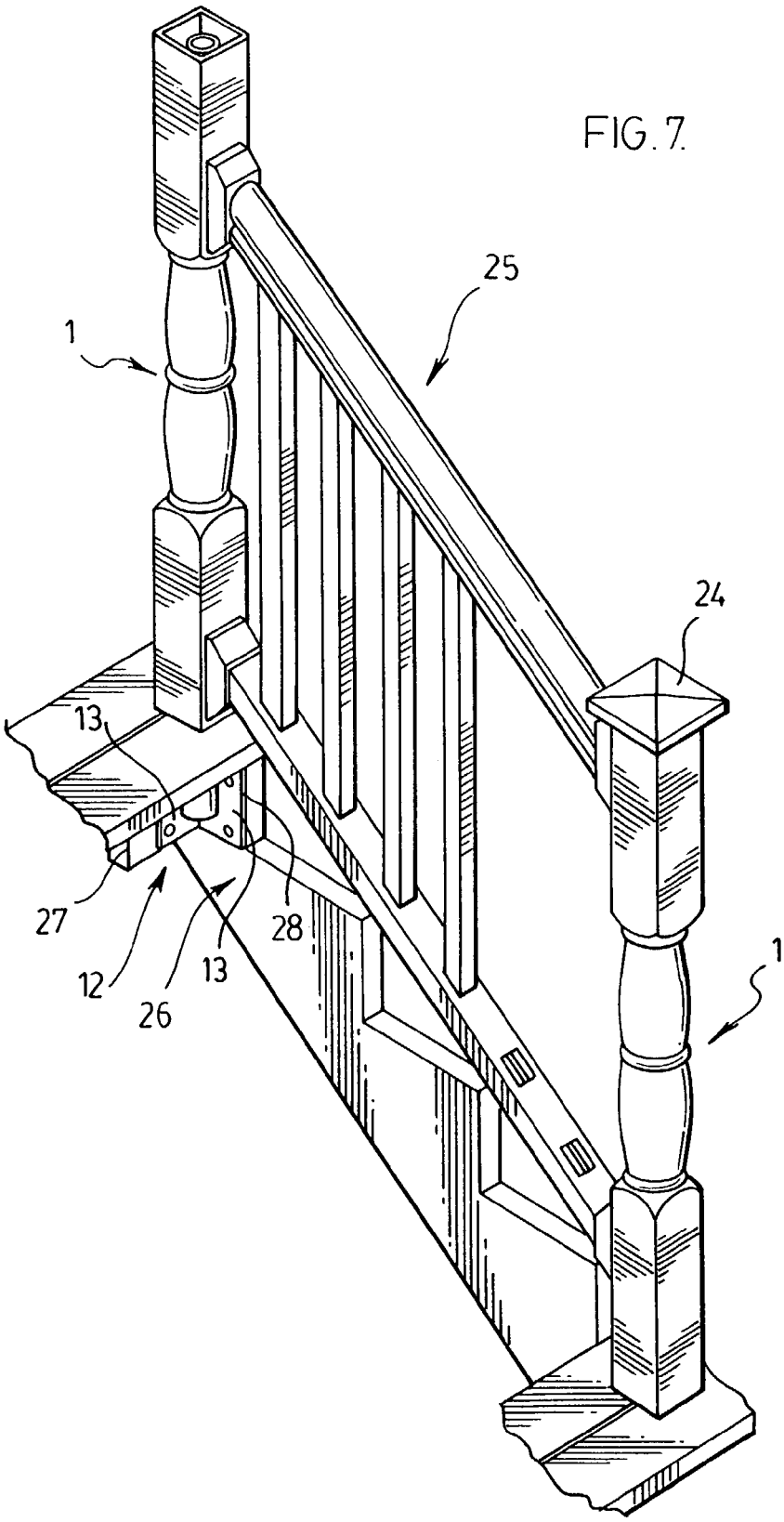
FIG. 7 is a perspective view again illustrating the use of the support post to support a railing going up a stairway.

FIG. 7 is a view analogous to FIG. 6 but showing a pair of posts 1 supporting railing formation 25 going up a steep set of steps 26. As illustrated in FIG. 7, the upper post 1 is secured in the upright position by means of the right angular member 12 welded to the bottom of the tube 6 with the wings 13 secured to right angularly disposed surfaces 27 and 28 of the steps 26.

As will be seen from FIG. 6, the ends of the longitudinal rails 29 of the railing formation 23 are aligned with the flanges 18 of the support brackets 9 and 10 respectively so that they can be secured in position by suitable fasteners driven through the post walls and into the flanges 18.

It will be understood that the same arrangement pertains to the longitudinal rails 30 of the railing formation 25 of FIG. 7.

Figure 8:
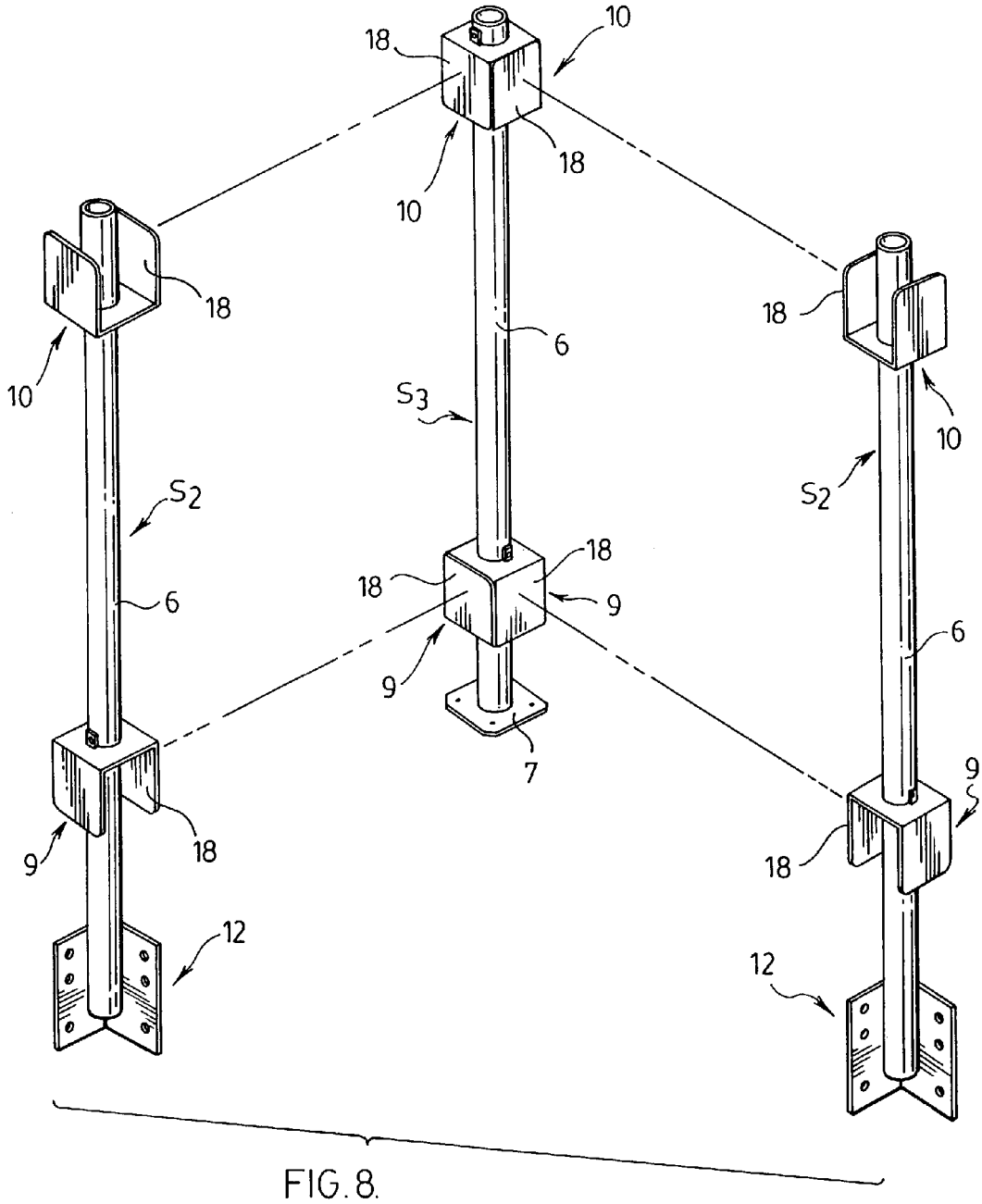
FIG. 8 is a perspective view illustrating an arrangement of internal support systems embodying the invention for internally supporting posts arranged to define a corner.

FIG. 8 is a perspective view illustrating an arrangement of internal hollow plastic post support systems to support posts arranged in right angular relationship as would occur with posts arranged to support railings at the corner of a deck or the like.

In this case, the middle internal support system designated generally at S3 which is between two S2 support systems is the same as the support system S1 in respect of the provision of the tube 6, the base plate 7, a lower support bracket 9 and an upper support bracket 10. However, support system S3 incorporates an additional lower support bracket 9 arranged at right angles to the first support bracket 9. Similarly, it incorporates a second upper support bracket 10 oriented at right angles to the first upper support bracket 10 so that both at the bottom and top there are support bracket flanges 18 facing the flanges 18 of both of the support systems S2 as illustrated by the dotted lines.

It will be understood of course that the base plate 7 of the support system S3 could be replaced by an angle member 12 depending on the convenience of securing the tube 6 in the upright position. In the same vein, the systems S2 shown in FIG. 8 could be replaced by S1 systems in which the angle iron members at the bottom of the tubes 6 would be replaced by mounting plates 7.

Figure 10:
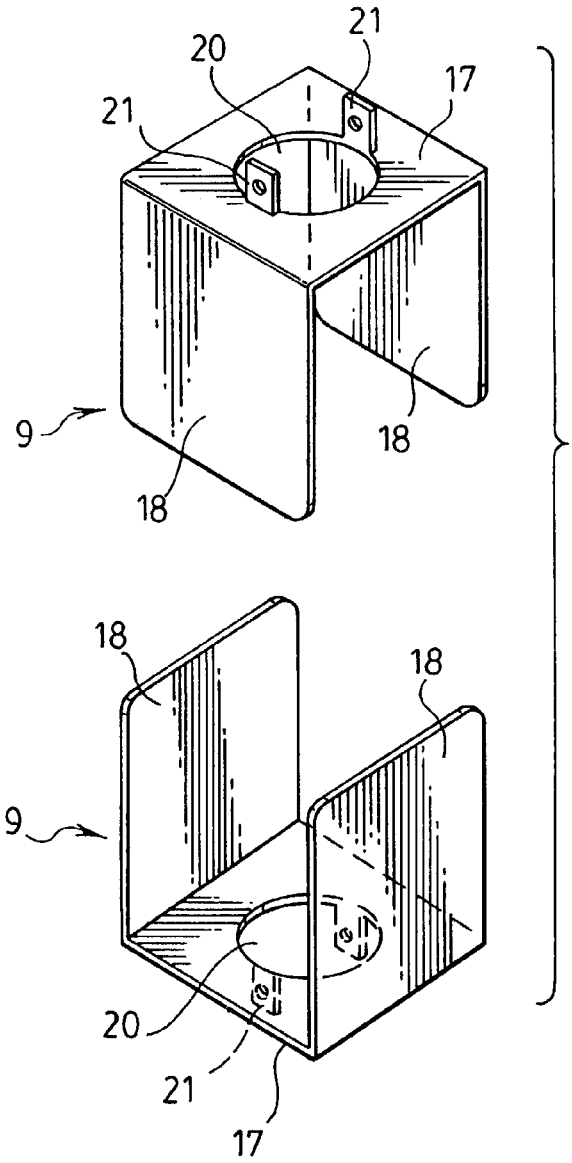
FIG. 10 is an enlarged perspective view of the separate brackets ready to be assembled to provide the square bracket assembly shown in FIG. 9.
Figure 9:
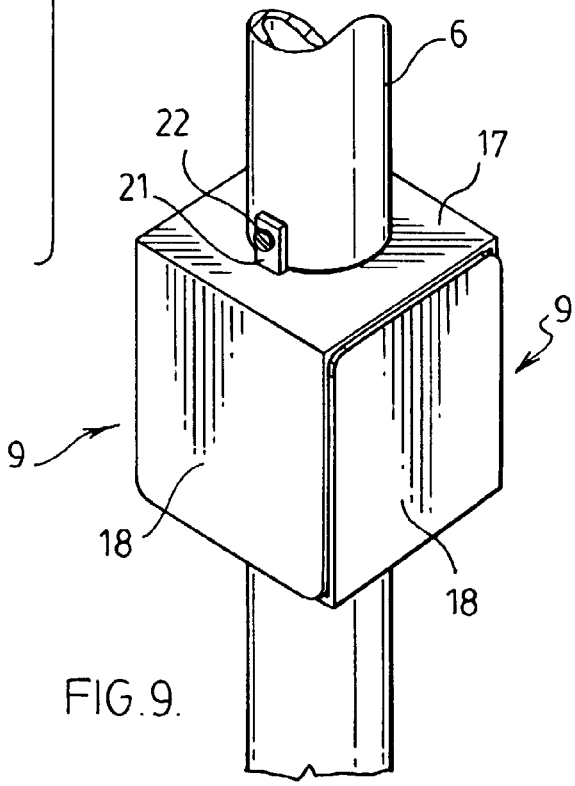
FIG. 9 is an enlarged perspective view of the upper bracket of the support system for the corner post illustrated in FIG. 8.

FIGS. 9 and 10 illustrate how, for example, the two lower support brackets are mounted on the tube 6 in right angular relation. This is accomplished by having one of the support brackets 9 with its flanges 18 facing upwardly and its ears 21 facing downwardly while the other one has its flanges facing downwardly and its ears facing upwardly, the two brackets being oriented in right angular relationship.

Figure 11:
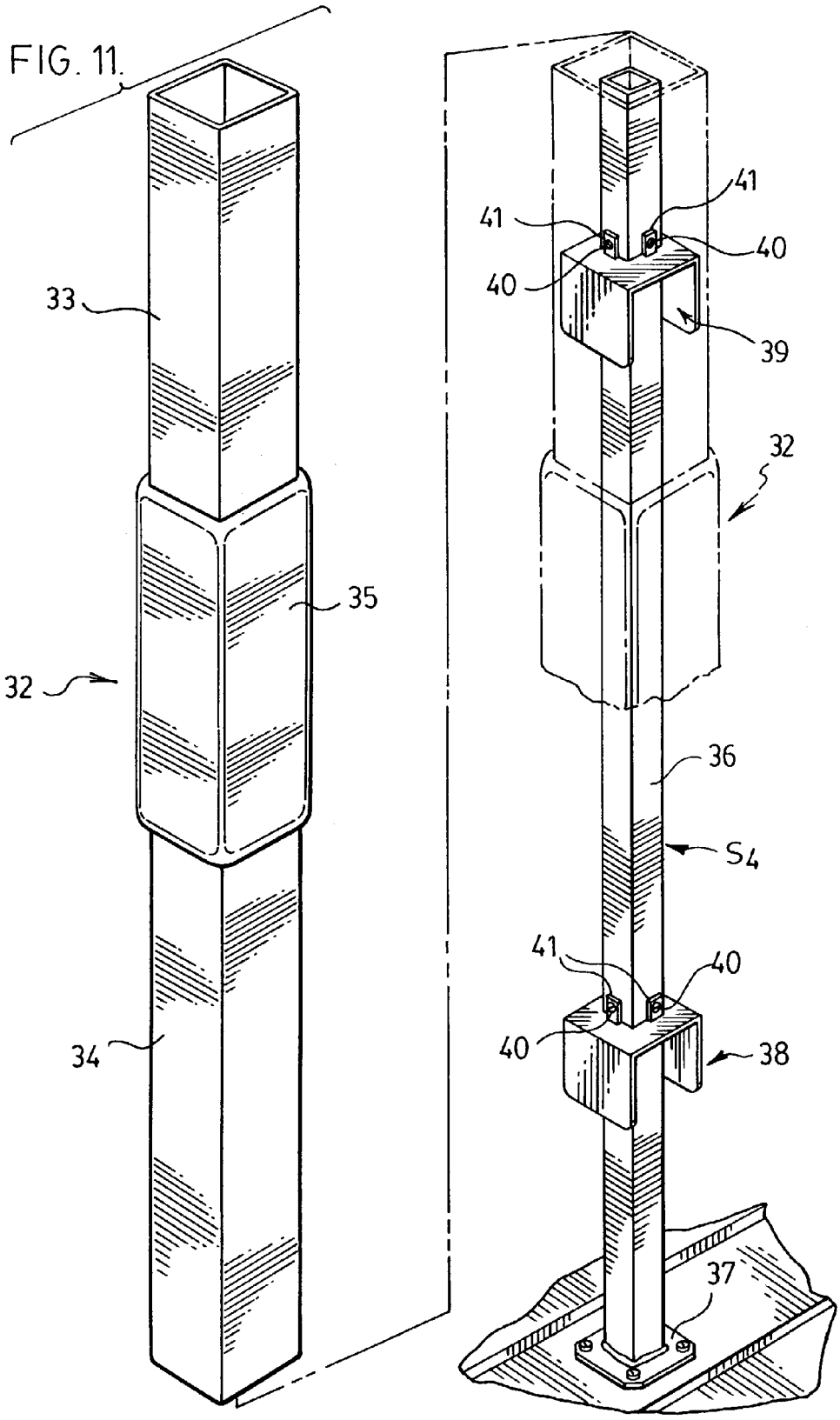
FIG. 11 is an exploded perspective view illustrating an hollow plastic post having a different configuration from the post of FIG. 1 ready to be sleeved on to a support system embodying the invention.

While the invention has been particularly described with reference to a Colonial Post, it will be appreciated that the internal support system is applicable to all sorts of different hollow plastic post shapes. For instance, as shown in FIG. 11, there is provided an internal support system generally designated at S4 for internally supporting a post 32. Post 32 is shown as having square cross section upper and lower end sections 33 and 34 respectively with an enlarged central square section 35.

The internal support system S4 is shown as comprising a square tube 36 to provide the required rigid supporting column, a mounting base plate 37 welded to the bottom of the tube 36, a lower support bracket 38 corresponding to support bracket 9 except that it has a central opening to receive the square tube 36 and an upper bracket 39 corresponding to upper bracket 10 except that it is provided with the square central opening to receive the square tube 36.

In this case, the internal support system S4 can be assembled and secured in place with the support brackets 38 and 39 secured to the tube 36 by screws 40 passing through ears 41 and into tube 36. The post 32 can then, as illustrated, be simply sleeved over the assembled internal support system S4.

It will be appreciated that many other variations in post configurations and internal support systems may be made without departing from the scope of the appended claims.

The invention claimed is:

1. An internally supported upright hollow plastic post comprising a hollow plastic post having a desired exterior wall contour along its length between an upper end and a lower end and a corresponding interior wall contour, a metal tube of a length to extend at least substantially throughout the length of said plastic post, said tube having a mounting means secured at a lower end exposed exteriorly of the lower end of said post for securing said tube to a support surface with said tube in an upright vertical position, a lower metal support bracket configured to fit within the lower end of said plastic post sleeved on and slid down said tube from its upper end to a selected point near the lower end of said tube, said bracket being secured to said tube at said selected point, said post being sleeved on to said tube with its lower end sleeved over said lower support bracket, said lower support bracket including flange means juxtaposed to interior walls of said post to provide backing support therefore at said post lower end, and an upper support bracket snugly receivable within the upper end of said post said upper support bracket being sleeved on said tube within said upper post end, said upper bracket having flange means juxtaposed to interior walls of said post to provide backing support therefore at said post upper end.

2. An internally supported hollow plastic post as claimed in claim 1 in which said upper and lower ends of said post each has a square cross section, and said post between said upper and lower post ends has a contour having cross sections which are circular.

3. An internally supported hollow plastic post as claimed in claim 2 in which said support bracket near the lower end of said post comprises a metal strip having a horizontal planar bottom web with a central tube receiving opening and a length for spanning between the opposed internal walls of said square cross section lower end section of the post, said planar bottom web having at each end of its length a leg extending perpendicular to said web to provide internal post wall backing support to said opposed internal walls of said lower end section, said web having ears struck up therefrom in a direction opposite to said legs with the securement of said support bracket in said lower post end section being effected by fasteners passing through said ears and into said post.

4. An internally supported hollow plastic post as claimed in claim 3 in which said tube has secured thereto within said lower square cross section end section of said post a second support bracket identical to said first mentioned support bracket received in said lower post end section, said support brackets secured within said post lower end being oriented at right angles to each other with their legs projecting in opposite directions such that said lower end support brackets form a four sided square support bracket assembly.

5. An internally supported hollow plastic post as claimed in claim 4 in which said upper support bracket received in the upper end of said post comprises a metal strip having a horizontal planar bottom web with a central tube receiving opening, said web having a length for spanning between the opposed internal wails of said square cross section upper end section of the post, said planar bottom web having at each end of its length a leg extending perpendicular to said web to provide internal post wall backing support to said opposed internal walls of said upper end section.

6. An internally supported hollow plastic post as claimed in claim 5 having a second upper support bracket received in the upper square cross section end section of said plastic post said second upper support bracket being identical with said first mentioned upper support bracket, said first and second upper support brackets being arranged in right angular relationship with the legs of one projecting in the opposite direction to the legs of the other such that said upper end support brackets form a four sided square support bracket assembly.

7. An internally supported hollow plastic post as claimed in claim 6, in which said mounting means at the bottom for securing said tube to a support surface comprises a metal plate secured to the lower end of said tube.

8. An internally supported hollow plastic post as claimed in claim 6 in which said means at the lower end of said tube for securing said tube to a support surface comprises a right angled bracket having planar wings whose planes are parallel to the axis of said tube.

* * * * *